US006505596B2

(12) United States Patent
Ito et al.

(10) Patent No.: US 6,505,596 B2
(45) Date of Patent: Jan. 14, 2003

(54) HANDHELD TYPE FOUR-CYCLE ENGINE

(75) Inventors: Keita Ito, Wako (JP); Takao Nishida, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/798,038

(22) Filed: Mar. 5, 2001

(65) Prior Publication Data

US 2001/0029921 A1 Oct. 18, 2001

(30) Foreign Application Priority Data

Mar. 14, 2000 (JP) ..... 2000-076407
Mar. 14, 2000 (JP) ..... 2000-076408

(51) Int. Cl.[7] ..... F01M 1/00
(52) U.S. Cl. ..... 123/196 R; 123/41.56
(58) Field of Search ..... 123/195 R, 90.53, 123/311.84, 195.5, 196 R, 141.86, 573, 572, 574; 30/216; 184/6.5, 6.8, 6.9, 6, 6.26, 11.1, 13.1

(56) References Cited

U.S. PATENT DOCUMENTS 5,640,936 A * 6/1997 Hudson ..... 123/196 W
5,738,062 A 4/1998 Everts ..... 123/195 R
5,960,764 A 10/1999 Araki ..... 123/196 R
5,975,042 A * 11/1999 Aizawa et al. ..... 123/196 M
5,988,135 A * 11/1999 Moorman et al. ..... 123/196 W
6,021,766 A * 2/2000 Maeda et al. ..... 123/573

FOREIGN PATENT DOCUMENTS

| | | |
|---|---|---|
| EP | 0 752 518 A1 | 1/1997 |
| EP | 0 752 518 | 1/1997 |
| EP | 0 911 496 A1 | 4/1999 |
| EP | 0 962 630 A2 | 12/1999 |
| JP | 10-288019 | 10/1998 |
| WO | WO 99/02824 | 1/1999 |

* cited by examiner

*Primary Examiner*—Willis R. Wolfe
*Assistant Examiner*—Rebecca A Smith
(74) *Attorney, Agent, or Firm*—Armstrong, Westerman & Hattori, LLP

(57) ABSTRACT

In a handheld type four-cycle engine, the lubricating system includes an oil tank placed outside an engine main body, a through hole providing communication between the oil tank and a crank chamber, an oil feed pipe placed outside the engine main body and providing communication between the crank chamber and a valve operation chamber of a cylinder head, an oil return pipe placed outside the engine main body and providing communication between the valve operation chamber and the oil tank, and a one-way valve for transferring oil from the crank chamber to the valve operation chamber side via the oil feed pipe. The side walls of the engine main body can thus be made thinner and the weight of the engine main body can therefore be reduced regardless of the presence of the oil feed pipe and the oil return pipe.

5 Claims, 11 Drawing Sheets

HANDHELD TYPE FOUR-CYCLE ENGINE

BACKGROUND OF THE INVENTION

1. Field of the Invention

The present invention relates to handheld type four-cycle engines which are mainly used as a power source for machines for portable operation such as trimmers. More particularly, it relates to improvement of a four-cycle engine that includes an engine main body, the engine body including a crankcase having a crank chamber, a cylinder block having a cylinder bore and a cylinder head having an intake port and an exhaust port; a crankshaft supported in the crankcase and housed inside the crank chamber; a piston fitted in the cylinder bore and connected to the crankshaft; an intake valve and an exhaust valve for opening and closing the intake port and exhaust port, the intake valve and exhaust valve being mounted to the cylinder head; a valve operation mechanism operable in association with the rotation of the crankshaft so as to open and close the intake valve and exhaust valve; and a power output or takeoff mechanism provided on one end of the crankshaft.

2. Description of the Related Art

Such a handheld type four-cycle engine is already known as disclosed in, for example, Japanese Patent Application Laid-open No. 10-288019.

Handheld type four-cycle engines are of course useful in terms of the prevention of environmental pollution as well as assuring the operators' health since the exhaust gas is comparatively clean. However, since the structure thereof is more complicated than that of two-cycle engines, there is a drawback that it is difficult to reduce the weight thereof. Reduction in weight is an important issue particularly for improvements in the operability of handheld four-cycle engines.

However, in the handheld type four-cycle engine disclosed in the above-mentioned patent publication, since a lubricating oil passage providing communication between the crank chamber and the valve operation mechanism is formed in a side wall of the engine main body in order to lubricate the valve operation mechanism for opening and closing the intake and exhaust valves provided in the cylinder head, the thickness of the side wall of the engine main body inevitably increases so enlarging the size thereof and thus making it difficult to reduce the weight of the engine.

SUMMARY OF THE INVENTION

The present invention has been carried out in view of the above-mentioned circumstances, and it is an object of the present invention to provide a lightweight handheld type four-cycle engine having good operability by making the engine main body compact.

In accordance with a first aspect of the present invention in order to achieve the above-mentioned objective, there is proposed a handheld type four-cycle engine including an engine main body, the engine main body including a crankcase having a crank chamber, a cylinder block having a cylinder bore and a cylinder head having an intake port and an exhaust port; a crankshaft supported in the crankcase and housed inside the crank chamber; a piston fitted inside the cylinder bore and connected to the crankshaft; an intake valve and an exhaust valve for opening and closing the intake port and exhaust port, the intake valve and the exhaust valve being mounted in the cylinder head; a valve operation mechanism operable in association with the rotation of the crankshaft so as to open and close the intake valve and the exhaust valve; and a power output mechanism provided on one end of the crankshaft projecting out of the engine main body, wherein a lubrication system includes an oil tank placed outside the engine body and storing lubricating oil; a through hole providing communication between the oil tank and the crank chamber; an oil feed pipe placed outside the engine main body and providing communication between the crank chamber and a valve operation chamber, the valve operation chamber being formed in the cylinder head so as to house the valve operation mechanism; an oil return pipe also placed outside the engine main body and providing communication between the valve operation chamber and the oil tank; and transfer means for transferring the oil inside the oil tank to the oil feed pipe via the crank chamber.

The above-mentioned power output mechanism corresponds to the centrifugal clutch described in the embodiment below, and the transfer means corresponds to the one-way valve 61 in the embodiment.

In accordance with the above-mentioned first characteristic, since the oil feed pipe and the oil return pipe are placed outside the engine main body, it is possible to make the side walls of the engine main body thinner regardless of the presence of these pipes, and the engine main body can thus be made compact so achieving a great reduction in the weight of the whole engine. Moreover, the externally placed oil feed pipe and oil return pipe are less influenced by heat from the engine main body, and it is thus possible to prevent the lubricating oil from becoming overheated.

In accordance with a second aspect of the present invention, in addition to the above-mentioned first characteristic, there is proposed a handheld type four-cycle engine wherein oil mist generation means for generating an oil mist from the stored oil is provided inside the oil tank, and the transfer means for transferring the oil mist generated inside the oil tank to the oil feed pipe includes valve means for introducing the positive pressure component of pressure pulsations of the crank chamber to the oil feed pipe.

The above-mentioned valve means corresponds to the one-way valve 61 described in the embodiment below.

In accordance with the above-mentioned second characteristic, since the oil mist generated in the oil tank is supplied to the crank chamber and the valve operation chamber by utilising the pressure pulsations of the crank chamber and is further returned to the oil tank 40, the inside of the engine can be effectively lubricated in any operational position of the engine and, moreover, a special oil pump for circulating the oil mist is unnecessary and the structure can thus be simplified.

In accordance with a third aspect of the present invention, in addition to the above-mentioned first or second characteristic, there is proposed a handheld type four-cycle engine wherein the oil feed pipe and the oil return pipe are formed integrally with a belt cover provided between the outside face of the engine main body and a timing transmission of the valve operation mechanism.

In accordance with the above-mentioned third characteristic, the integral formation of the oil feed pipe and the oil return pipe with the belt cover can contribute to a reduction in the number of parts and an enhancement of the assembly performance In accordance with a fourth aspect of the present invention, in addition to the above-mentioned first or second characteristic, there is proposed a handheld type four-cycle engine wherein the oil feed pipe and the oil return pipe include flexible tubes.

In accordance with the above-mentioned fourth characteristic, the oil feed pipe and the oil return pipe can be freely fitted to connection points, wherever the points are, by appropriately flexing these pipes, and the degrees of freedom of the layout can be increased.

In accordance with a fifth aspect of the present invention, in addition to the above-mentioned first characteristic, there is proposed a handheld type four-cycle engine wherein the valve operation mechanism includes a camshaft supported in a rotatable manner in the cylinder head so as to open and close the intake valve and the exhaust valve, and a dry system timing transmission placed outside the engine main body and operable in association with the crankshaft to the camshaft; oil mist generation means for generating an oil mist from the stored oil is provided inside the oil tank; and the transfer means for transferring the oil mist generated inside the oil tank to the oil feed pipe includes valve means for introducing the positive pressure component of pressure pulsations of the crank chamber to the oil feed pipe.

In accordance with the above-mentioned fifth characteristic, since the engine is made in the form of an OHC type, and the timing transmission system is made in the form of a dry system and placed outside the engine main body, it is unnecessary to specially provide a transmission chamber for housing the timing transmission on the side wall of the engine main body and it is therefore possible to make the engine main body thin and compact and to reduce the overall weight of the engine to a great extent. Since the valve means feeds the positive pressure component of the pressure pulsations of the crank chamber to the valve operation chamber side, the oil mist generated in the oil tank on the engine main body side is circulated to the crank chamber, the valve operation chamber and the oil tank via the oil feed pipe and the oil return pipe so lubricating the inside of the engine in any operational position of the engine. Moreover, it is unnecessary to provide a special oil pump for the circulation of oil so contributing to a simplification of the structure and, as a result, a reduction in the cost.

Furthermore, in accordance with a sixth aspect of the present invention, in addition to the above-mentioned second or fifth characteristic, there is proposed a handheld type four-cycle engine wherein a suction chamber adjoining the upper part of the valve operation chamber is provided in the cylinder head, the oil return pipe being connected to the suction chamber, and the suction chamber is communicated with to the valve operation chamber via a plurality of orifices at different height levels.

In accordance with the above-mentioned sixth characteristic, even if the oil mist liquefies and resides in the valve operation chamber, this liquefied oil can be returned to the oil tank by drawing it up into the suction chamber via one of the orifices regardless of the positional state of the engine such as an upright or upside down state, and it is thus possible to prevent oil remaining in the valve operation chamber.

The above-mentioned objectives, other objectives, characteristics and advantages of the present invention will become apparent from an explanation of preferable embodiments which will be described in detail below by reference to the attached drawings.

DESCRIPTION OF PREFERRED EMBODIMENTS

An embodiment of the present invention is explained below by reference to the attached drawings.

Figure 1:
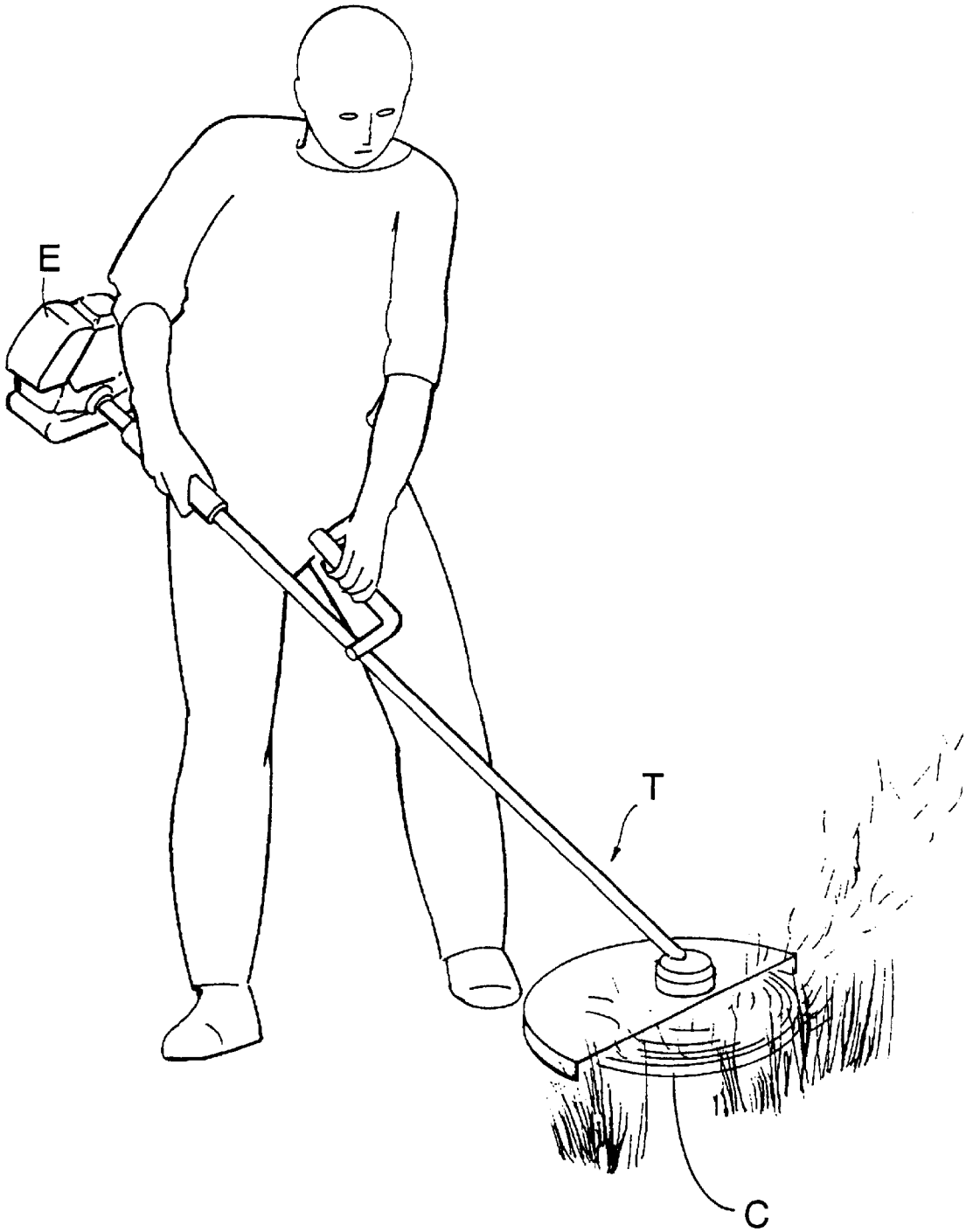
FIG. 1 is an oblique view showing one embodiment of the handheld type four-cycle engine of the present invention in practical use.

As shown in FIG. 1, a handheld type four-cycle engine E is attached as a source of power to the drive section of, for example, a powered trimmer T. Since the powered trimmer T is used in a manner in which a cutter C is positioned in various directions according to the operational conditions, the engine E is also tilted to a large extent or turned upside-down as a result and the operational position is unstable.

Firstly, the overall arrangement of the handheld type four-cycle engine is explained by reference to FIGS. 2 to 5.

Figure 2:
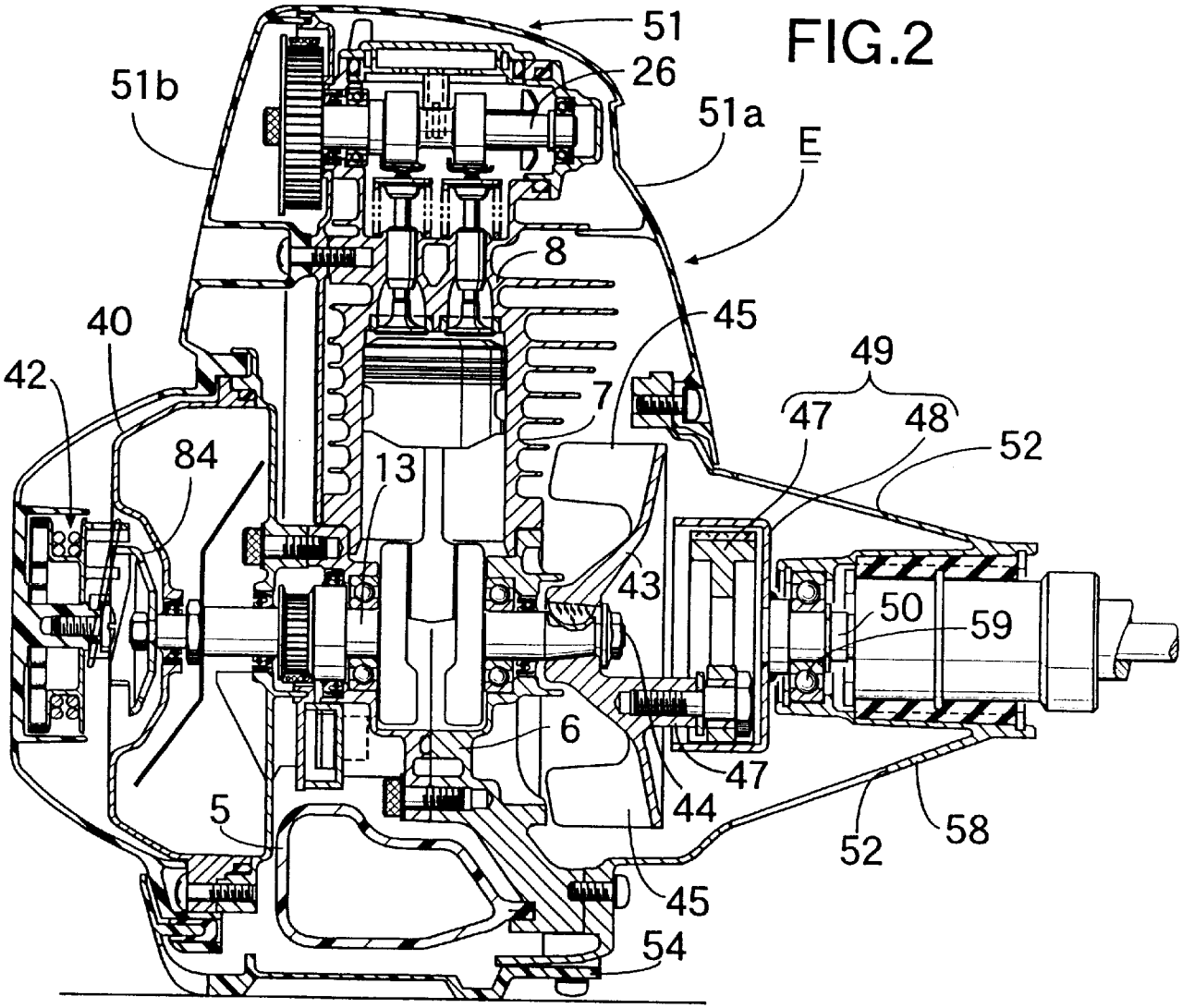
FIG. 2 is a longitudinal side view of the above-mentioned four-cycle engine.
Figure 3:
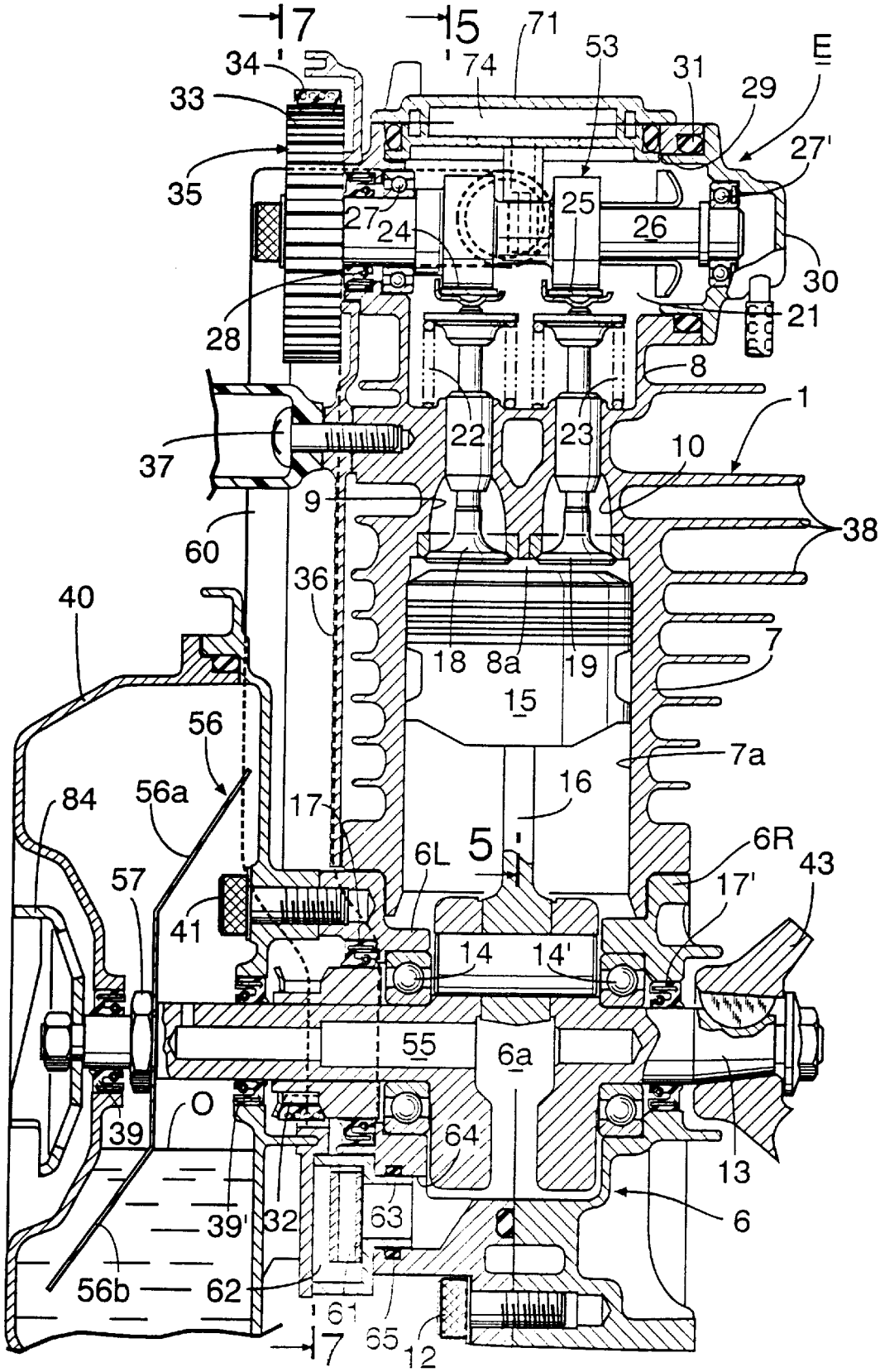
FIG. 3 is a magnified view of an essential part of FIG. 2.
Figure 5:
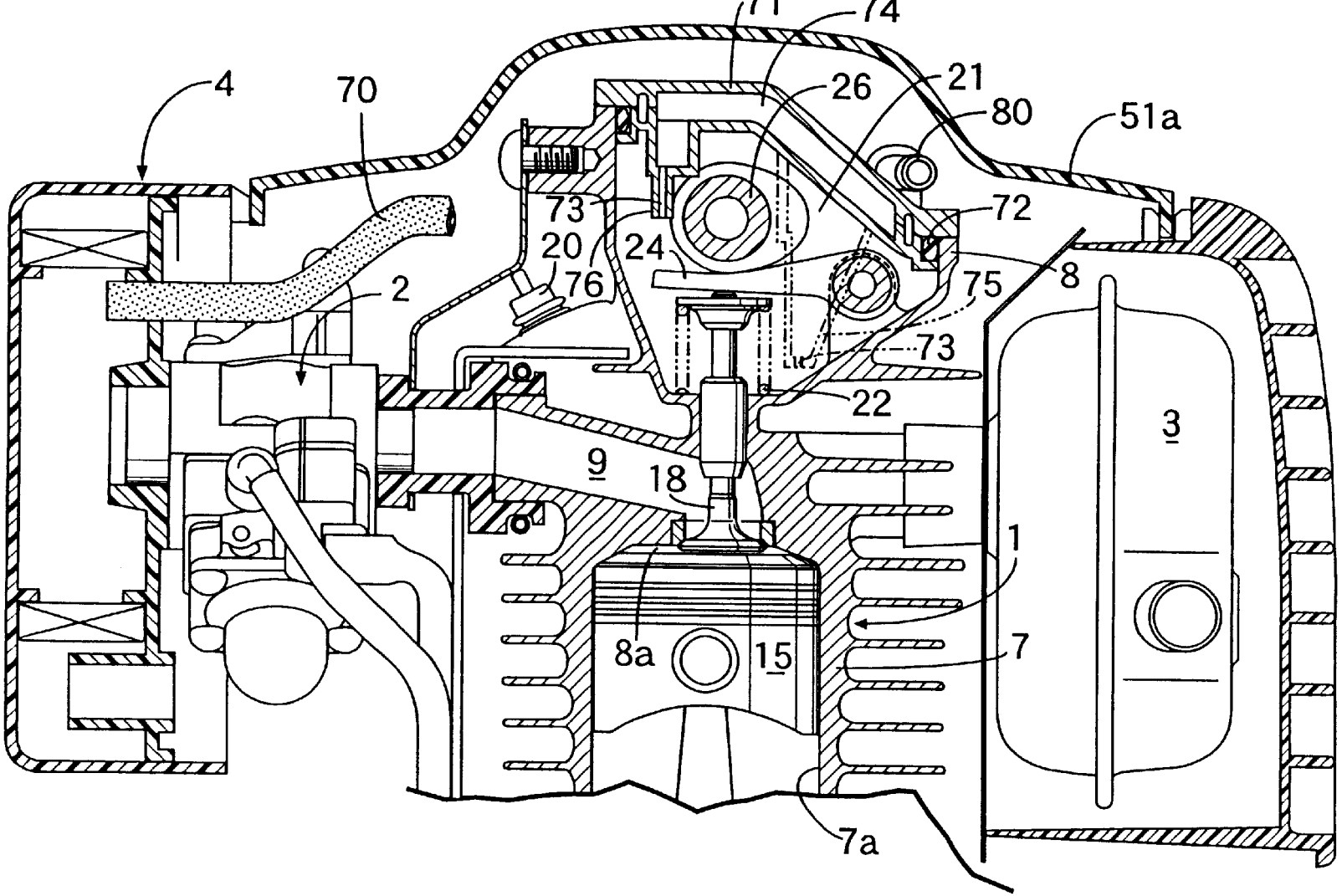
FIG. 5 is a cross-sectional view at line 5—5 in FIG. 3.

As shown in FIGS. 2, 3 and 5, a carburettor 2 and an exhaust muffler 3 are attached to the front and back respectively of an engine main body 1 of the above-mentioned handheld type four-cycle engine E, and an air cleaner 4 is attached to the inlet of the carburettor 2. A fuel tank 5 made of a synthetic resin is attached to the lower face of the engine main body 1.

The engine main body 1 includes a crankcase 6 having a crank chamber 6*a,* a cylinder block 7 having one cylinder bore 7*a,* and a cylinder head 8 having a combustion chamber 8*a* and intake and exhaust ports 9 and 10 which open into the combustion chamber 8*a*. The cylinder block 7 and the cylinder head 8 are integrally cast, and the separately cast crankcase 6 is bolt-joined to the lower end of the cylinder block 7. The crankcase 6 is formed from first and second case halves 6L and 6R, and the two case halves 6L and 6R are joined to each other by means of a bolt 12. A large number of cooling fins 38 are formed on the outer peripheries of the cylinder block 7 and the cylinder head 8.

A crankshaft 13 housed in the crank chamber 6*a* is supported in the first and second case halves 6L and 6R in a rotatable manner via ball bearings 14 and 14', and is connected to a piston 15 fitted in the cylinder bore 7*a* via a connecting rod 16. Moreover, oil seals 17 and 17' are fitted in the first and second case halves 6L and 6R, the oil seals 17 and 17' adjoining the above-mentioned bearings 14 and 14' and being in close contact with the outer circumference of the crankshaft 13.

An intake valve 18 and an exhaust valve 19 for opening and closing the intake port 9 and the exhaust port 10 respectively are provided in the cylinder head 8 parallel to the axis of the cylinder bore 7*a,* and a spark plug 20 is screwed in so that the electrodes thereof are close to the central area of the combustion chamber 8*a*.

The intake valve 18 and the exhaust valve 19 are forcedly closed by means of valve springs 22 and 23 in a valve operation chamber 21 formed in the cylinder head 8. In the valve operation chamber 21, cam followers 24 and 25 supported in the cylinder head 8 in a vertically rockable manner are superimposed on top of the intake valve 18 and the exhaust valve 19, and a camshaft 26 for opening and closing the intake valve 18 and the exhaust valve 19 via the cam followers 24 and 25 is supported in a rotatable manner via ball bearings 27' and 27 in the right and left side walls of the valve operation chamber 21, the camshaft 26 being parallel to the crankshaft 13. One side wall of the valve operation chamber 21 in which the bearing 27 is mounted is formed integrally with the cylinder head 8, and an oil seal 28 is mounted in this side wall in close contact with the outer circumference of the camshaft 26. The other side wall of the valve operation chamber 21 is provided with an insertion opening 29 to allow the camshaft 26 to be inserted into the valve operation chamber 21, and after inserting the camshaft 26, the other bearing 27' is mounted in a side wall cap 30 that blocks the insertion opening 29. The side wall cap 30 is fitted in the insertion opening 29 via a sealing member 31 and joined to the cylinder head 8 by means of a bolt.

Figure 4:
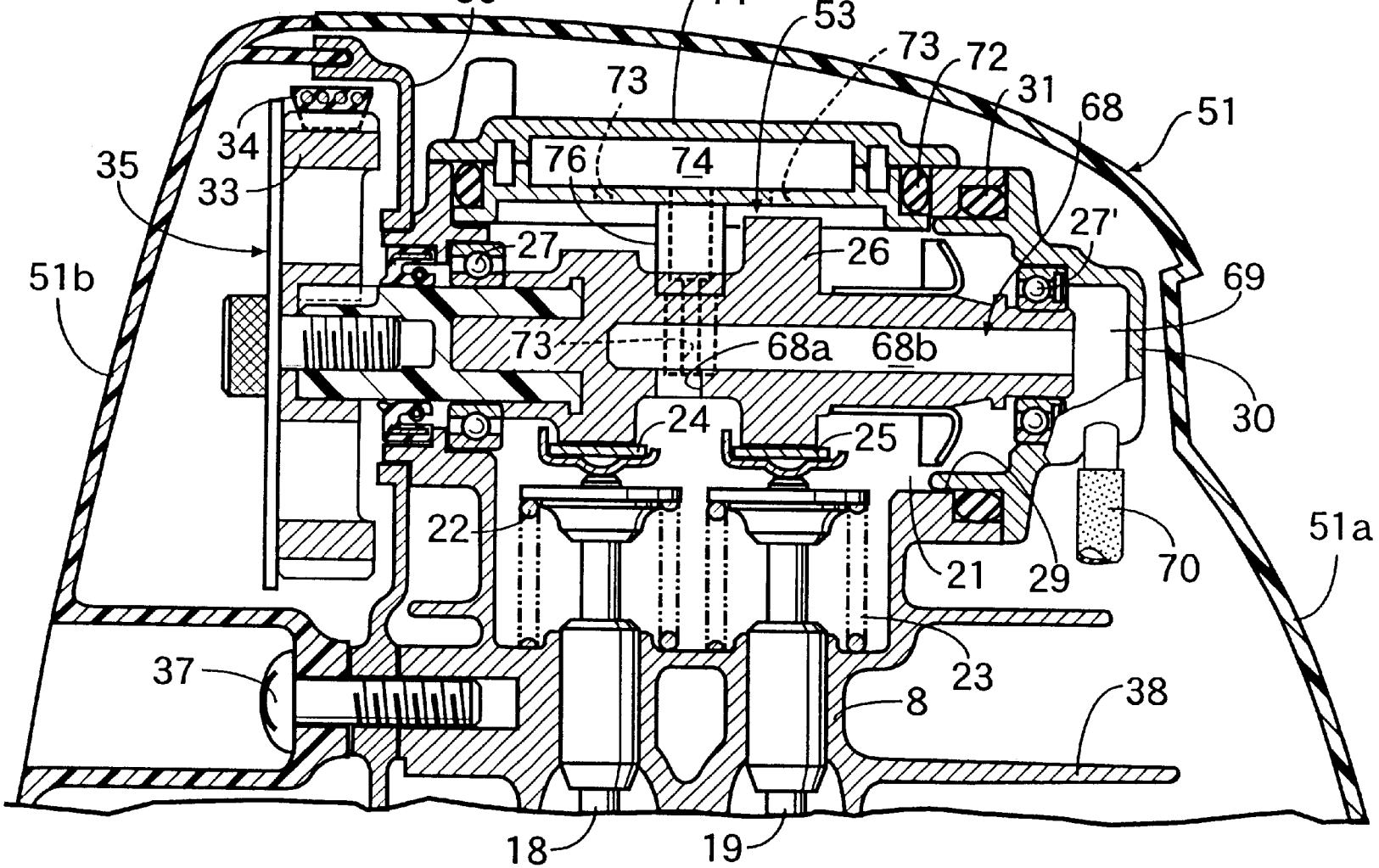
FIG. 4 is a magnified vertically sectioned view around the camshaft in FIG. 3.

As is clearly shown in FIGS. 3 and 4, one end of the camshaft 26 projects out of the cylinder head 8 on the side of the above-mentioned oil seal 28. One end of the crankshaft 13 also projects out of the crankcase 6 on the same side, a toothed drive pulley 32 is fixed to this end of the crankshaft 13, and a toothed driven pulley 33 having twice as many teeth as that of the drive pulley 32 is fixed to the end of the above-mentioned camshaft 26. A toothed timing belt 34 is wrapped around the two pulleys 32 and 33 so that the crankshaft 13 can drive the camshaft 26 with at a reduction rate of ½. The above-mentioned camshaft 26 and a timing transmission 35 form a valve operation mechanism 53.

The engine E is thus arranged in the form of an OHC type, and the timing transmission 35 is in the form of a dry system which is placed outside the engine main body 1.

A belt cover 36 made of a synthetic resin is placed between the engine main body 1 and the timing transmission 35, the belt cover 36 being fixed to the engine main body 1 by means of a bolt 37, so that the heat radiated from the engine main body 1 is prevented from affecting the timing transmission 35.

An oil tank 40 made of a synthetic resin placed so as to cover a part of the outer face of the timing transmission 35 is fixed to the engine main body 1 by means of a bolt 41 and, moreover, a recoil type starter 42 (see FIG. 2) is fitted to the outer face of the oil tank 40.

Referring again to FIG. 2, the end of the crankshaft 13 opposite to the end of the timing transmission 35 also projects out of the crankcase 6, and a flywheel 43 is fixed to the end by means of a nut 44. A large number of cooling vanes 45, 45 . . . are integrally provided on the inner face of the flywheel 43 so that the flywheel 43 can also function as cooling means. A plurality of fitting bosses 46 (one thereof is shown in FIG. 2) are formed on the outer face of the flywheel 43, and a centrifugal shoe 47 is pivotally supported on each of the fitting bosses 46. These centrifugal shoes 47, together with a clutch drum 48 fixed to the drive shaft 50 which will be described below, form a centrifugal clutch 49, and when the rotational rate of the crankshaft 13 exceeds a predetermined value, the centrifugal shoes 47 are pressed onto the inner periphery of the clutch drum 48 due to the centrifugal force of the shoe so transmitting the output torque of the crankshaft 13 to the drive shaft 50. The flywheel 43 has a larger diameter than that of the centrifugal clutch 49.

An engine cover 51 covering the engine main body 1 and its attachments is divided at the position of the timing transmission 35 into a first cover half 51*a* on the side of the flywheel 43 and a second cover half 51*b* on the side of the starter 42, and each of the cover halves 51*a* and 51*b* is fixed to the engine main body 1. A truncated cone shaped bearing holder 58 coaxially arranged with the crankshaft 13 is fixed to the first cover half 51*a*, the bearing holder 58 supporting the drive shaft 50 which rotates the above-mentioned cutter C via a rotating bearing 59, and an air intake opening 52 is provided in the bearing holder 58 so that outside air is drawn inside the engine cover 51 by rotation of the cooling vanes 45, 45 . . . . Furthermore, a base 54 for covering the lower face of the fuel tank 5 is fixed to the engine cover 51 and the bearing holder 58.

As mentioned above, since the timing transmission 35 for providing association between the crankshaft 13 and the camshaft 26 is arranged as a dry system outside the engine main body 1, it is unnecessary to provide a special compartment for housing the transmission 35 on the side wall of the engine main body 1 and it is therefore possible to make the engine main body 1 thin and compact and greatly reduce the overall weight of the engine E.

Moreover, since the timing transmission 35 and the centrifugal shoes 47 of the centrifugal clutch 49 are connected to the two ends of the crankshaft 13 with the cylinder block 7 interposed between them, the weights at the two ends of the crankshaft 13 are well balanced, the centre of gravity of the engine E can be set as close to the central part of the crankshaft 13 as possible, and the operability of the engine E can thus be enhanced while reducing the weight. Furthermore, since the loads from the timing transmission 35 and the drive shaft 50 separately work on the two ends of the crankshaft 13 during operation of the engine E, it is possible to prevent the load on the crankshaft 13 and the bearings 14 and 14' supporting the crankshaft 13 from being localised and the durability thereof can thus be enhanced.

Furthermore, since the flywheel 43 having a diameter larger than that of the centrifugal clutch 49 and having the cooling vanes 45 is fixed to the crankshaft 13 between the engine main body 1 and the centrifugal clutch 49, external air can be supplied effectively around the cylinder block 7 and the cylinder head 8 by introducing the air through the air intake opening 52 by rotation of the cooling vanes 45 without interference from the centrifugal clutch 49 thus enhancing the cooling performance while preventing any increase in the size of the engine E due to the flywheel 43.

Moreover, since the oil tank 40 is fitted to the engine main body 1 so as to adjoin the outside of the timing transmission 35, the oil tank 40 covers at least a part of the timing transmission 35 and can protect the transmission 35 in co-operation with the second cover half 51*b* covering the other part of the transmission 35. In addition, since the oil tank 40 and the flywheel 43 are arranged so as to face each other with the engine main body 1 interposed between them, the centre of gravity of the engine E can be set closer to the central part of the crankshaft 13.

The lubrication system of the above-mentioned engine E is explained below by reference to FIGS. 3 to 10.

As shown in FIG. 3, the crankshaft 13 is arranged so that one end thereof runs through the oil tank 40 while being in close contact with the oil seals 39 and 39' mounted in both the inside and outside walls of the oil tank 40, and a through hole 55 providing communication between the inside of the oil tank 40 and the crank chamber 6*a* is provided in the crankshaft 13. Lubricating oil O is stored in the oil tank 40, and the amount stored is set so that an open end of the above-mentioned through hole 55 inside the oil tank 40 is always above the liquid level of the oil O regardless of the operational position of the engine E.

An oil slinger 56 is fixed to the crankshaft 13 inside the oil tank 40 by means of a nut 57. The oil slinger 56 includes two blades 56*a* and 56*b* which extend in directions radially opposite to each other from the central part where the oil slinger 56 is fitted to the crankshaft 13, and which are bent in directions axially opposite to each other. When the oil slinger 56 is rotated by the crank shaft 13, at least one of the two blades 56*a* and 56*b* scatters the oil O inside the oil tank 40 so as to generate an oil mist regardless of the operational position of the engine E.

Figure 6:
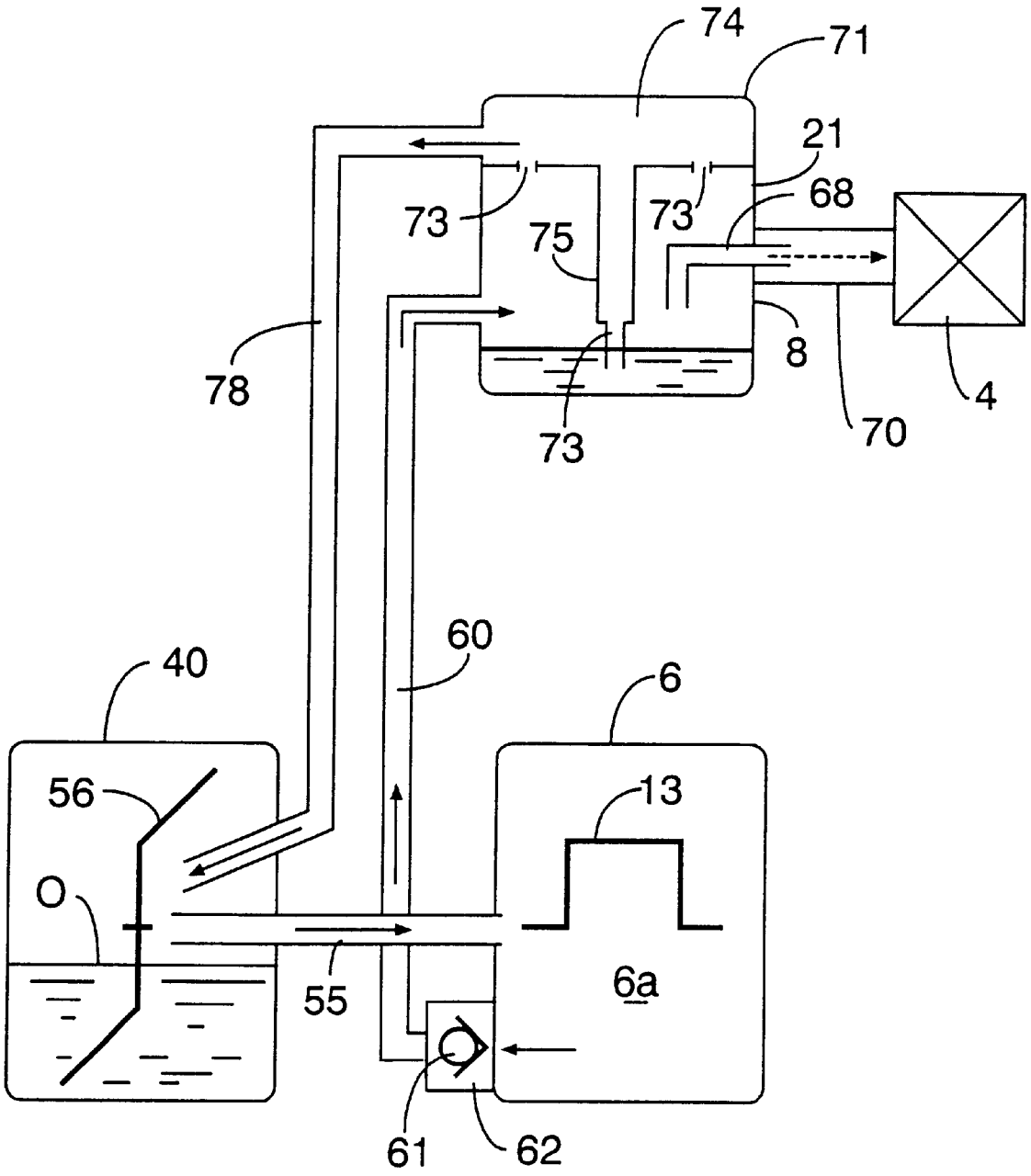
FIG. 6 is a schematic view of the lubrication system of the above-mentioned engine.
Figure 7:
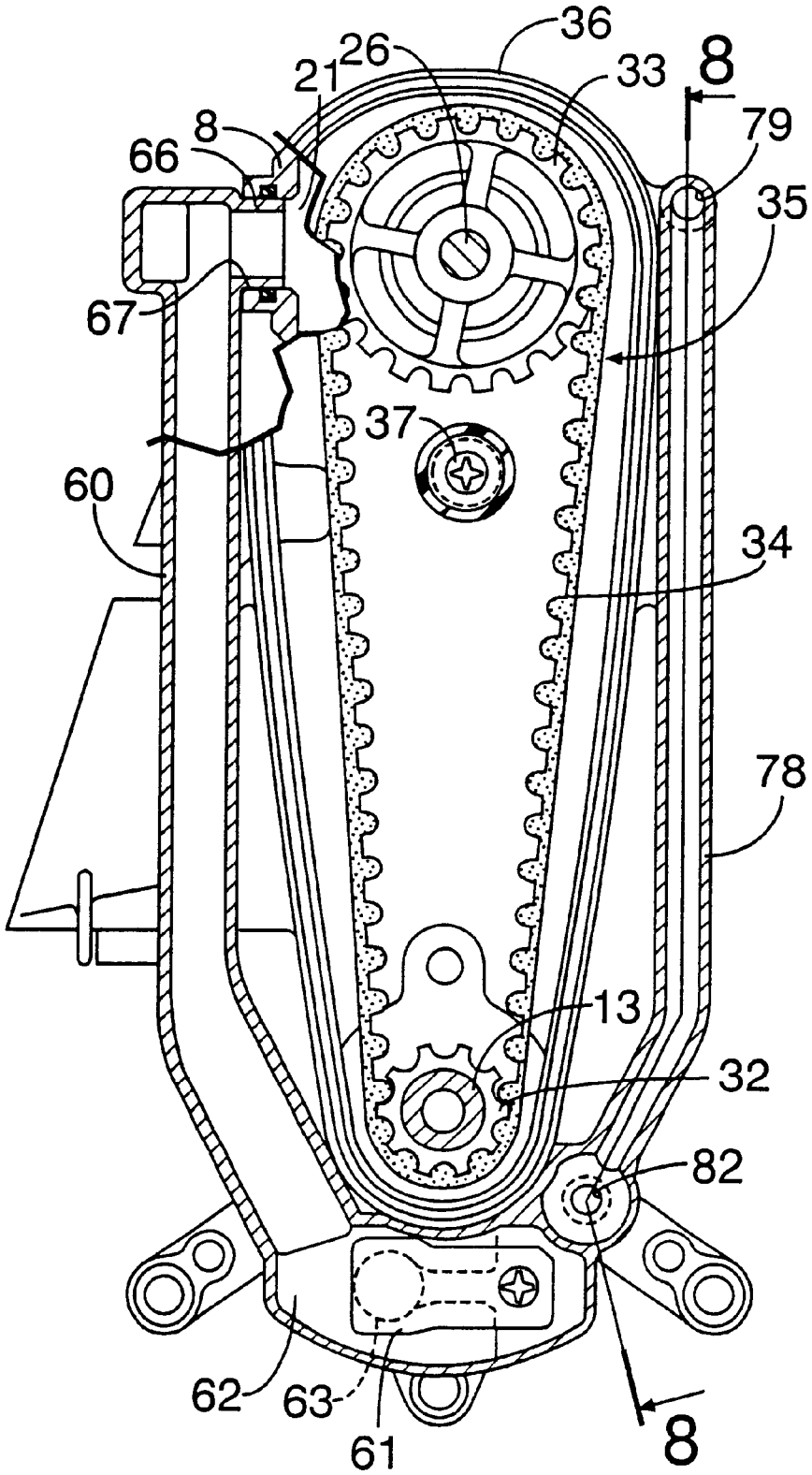
FIG. 7 is a cross-sectional view at line 7—7 in FIG. 3.

As shown in FIGS. 3, 6 and 7, the crank chamber 6*a* is connected to the valve operation camber 21 via an oil feed pipe 60, and a one-way valve 61 is provided in the oil feed pipe 60 so as to only allow flow in the direction from the crank chamber 6*a* to the valve operation chamber 21. The oil feed pipe 60 is formed integrally with the aforementioned belt cover 36 along one side edge thereof, and the lower end of the oil feed pipe 60 is formed in a valve chamber 62. An inlet pipe 63 projecting from the valve chamber 62 at the back of the belt cover 36 is formed integrally with the belt cover 36, and the inlet pipe 63 is fitted into a connection hole 64 in the lower part of the crankcase 6 via a sealing member 65 so that the inlet pipe 63 is communicated with the crank chamber 6*a*. The aforementioned one-way valve 61 is provided inside the valve chamber 62 so as to allow flow in the direction from the inlet pipe 63 to the valve chamber 62. This one-way valve 61 is a reed valve in the case of the illustrated embodiment.

An outlet pipe 66 projecting from the upper end of the oil feed pipe 60 at the back of the belt cover 36 is formed integrally with the belt cover 36, and the outlet pipe 66 is fitted into a connection hole 67 in a side of the cylinder head 8 so that the outlet pipe 66 is communicated with the valve operation chamber 21.

The valve operation chamber 21 thus communicated with the oil feed pipe 60 is communicated with a breather chamber 69 inside the side wall cap 30 via a gas-liquid separation passage 68 provided in the camshaft 26 and including a transverse hole 68*a* and a longitudinal hole 68*b*, and the breather chamber 69 is communicated with the inside of the aforementioned air cleaner 4 via a breather pipe 70.

Figure 9:
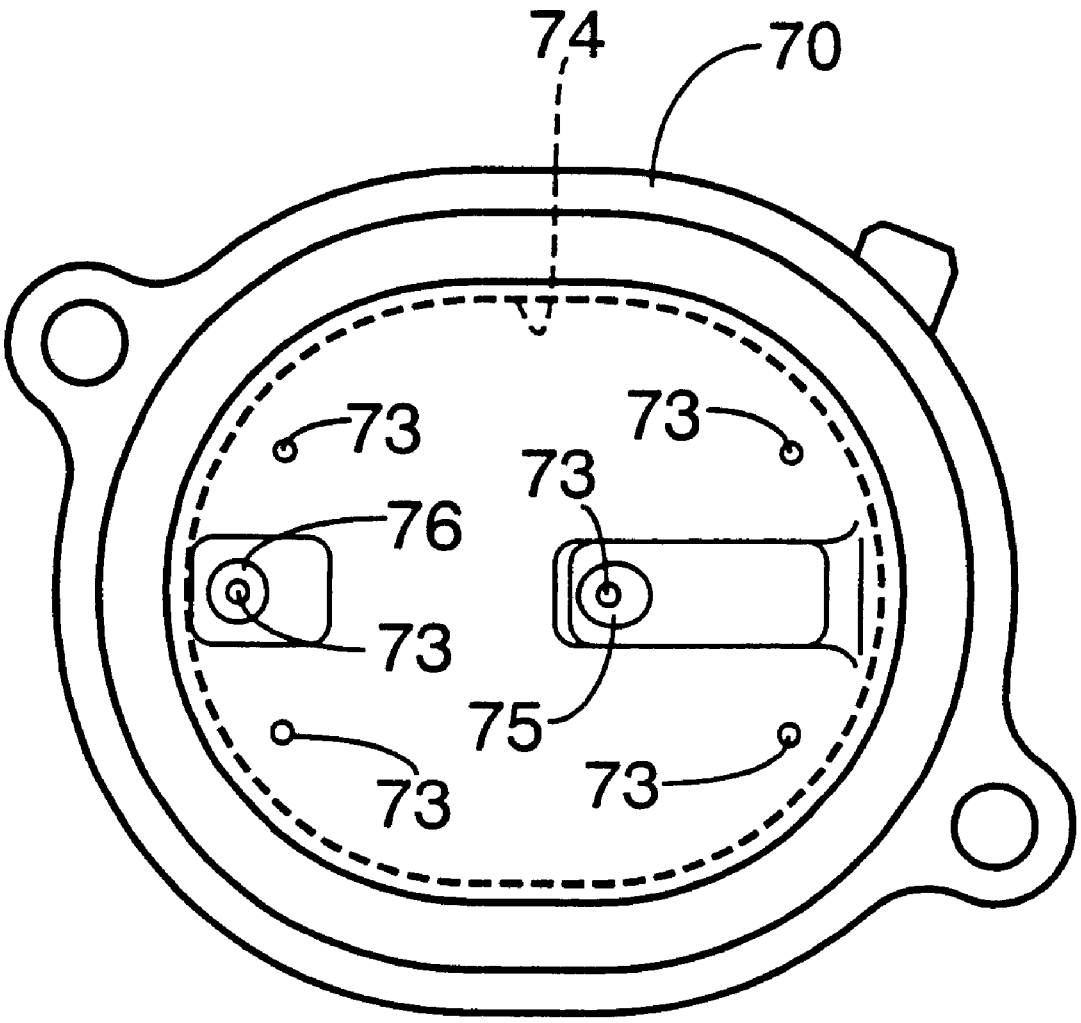
FIG. 9 is a bottom view of the head cover.
Figure 10A:
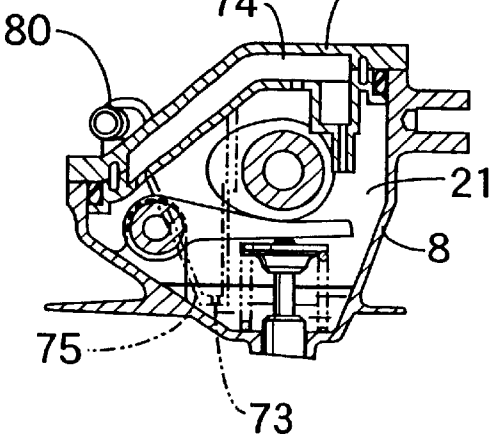
FIG. 10 is an explanatory view of the action of suction of the collected oil in the cylinder head in various operational positions of the engine.
Figure 10B:
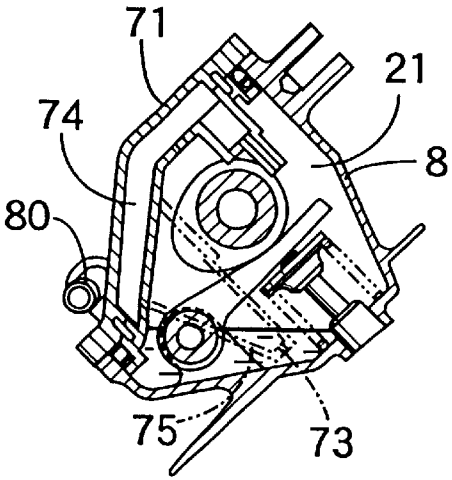
Figure 10C:
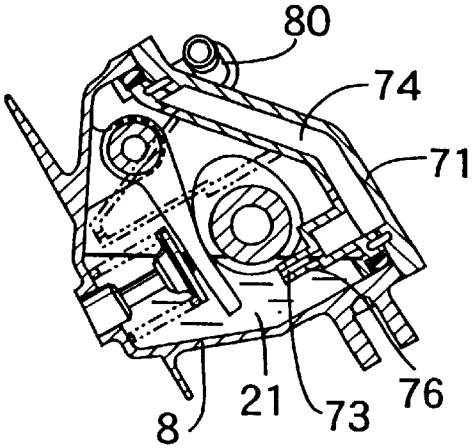
Figure 10D:
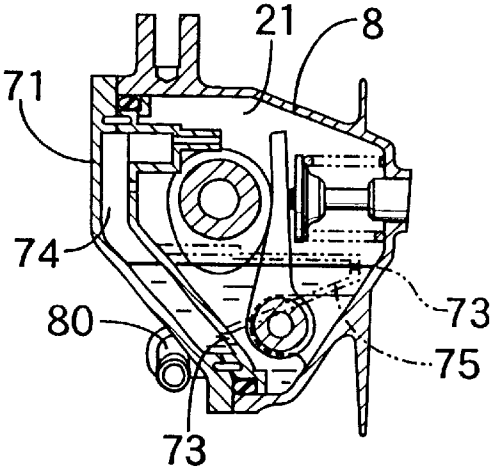
Figure 10E:
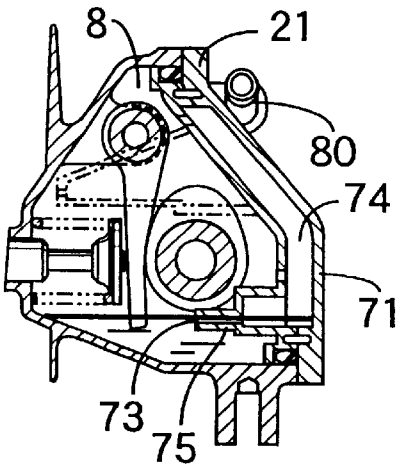
Figure 10F:
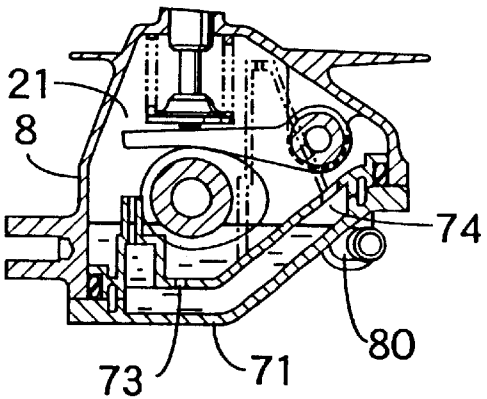

As is clearly shown in FIGS. 4 and 9, a head cover 71 for blocking the open upper face of the valve operation chamber 21 is joined to the cylinder head 8 via a sealing member 72. A suction chamber 74 communicated with the valve operation chamber 21 via a plurality of orifices 73, 73 . . . is formed in the head cover 71. The suction chamber 74 has a flattened shape along the upper face of the valve operation chamber 21, and is provided with four orifices 73, 73 . . . at four points in the bottom wall thereof. Long and short suction pipes 75 and 76 are formed integrally with the bottom wall of the suction chamber 74 in its central area, with a space between the long and short suction pipes 75 and 76 in the direction perpendicular to the axis of the camshaft 26, so as to project inside the valve operation chamber 21, and orifices 73 and 73 are provided in the suction pipes 75 and 76.

Figure 8:
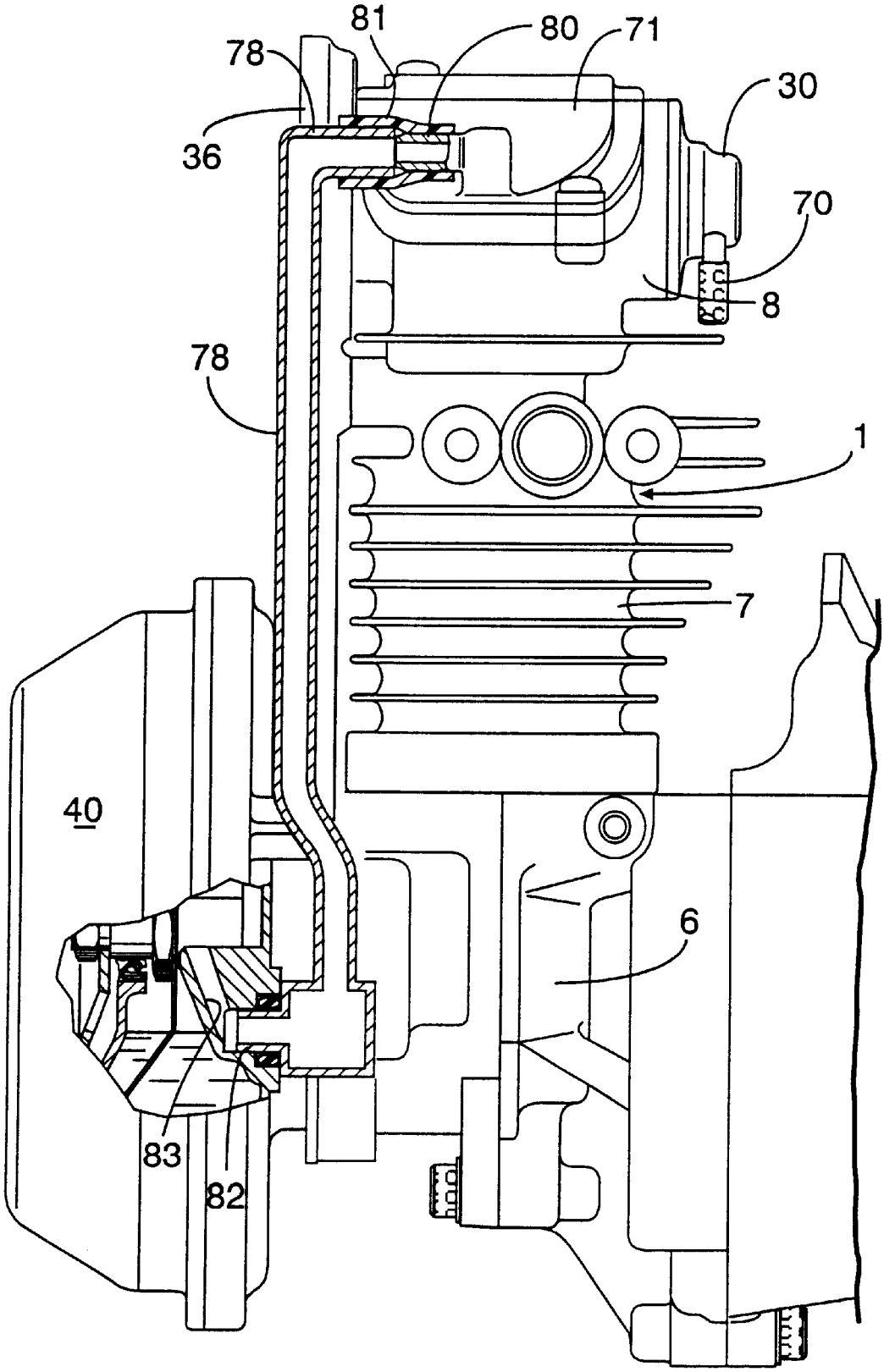
FIG. 8 is a cross-sectional view at line 8—8 in FIG. 7.

As shown in FIGS. 6 to 8, the suction chamber 74 is communicated also with the inside of the oil tank 40 via an oil return pipe 78. The oil return pipe 78 is formed integrally with the belt cover 36 along the edge thereof on the side opposite to that for the oil feed pipe 60. An inlet pipe 79 projecting from the upper end of the oil return pipe 78 at the back of the belt cover 36 is formed integrally with the belt cover 36, and the inlet pipe 79 is connected to an outlet pipe 80 which is formed in the head cover 71, via a connector 81, so that the inlet pipe 79 is communicated with the suction chamber 74.

Moreover, an outlet pipe 82 projecting from the lower end of the oil return pipe 78 at the back of the belt cover 36 is formed integrally with the belt cover 36, and the outlet pipe 82 is fitted into a return hole 83 provided in the oil tank 40 so that the outlet pipe 82 is communicated with the inside of the oil tank 40. The open end of the return hole 83 is positioned in the vicinity of the central part of the oil tank 40 so that the open end is above the liquid level of the oil inside the oil tank 40 regardless of the operational position of the engine E.

A driven member 84 driven by the above-mentioned recoil type starter 42 is fixed to the forward end of the crankshaft 13 which projects out of the oil tank 40.

Oil mist is generated by the oil slinger 56 scattering the lubricating oil O inside the oil tank 40 due to rotation of the crankshaft 13 during operation of the engine E, and when the pressure of the crank chamber 23 decreases due to the ascending movement of the piston 15 the oil mist so generated is taken into the crank chamber 6*a* via the through hole 55 so lubricating the crankshaft 13 and the piston 15. When the pressure of the crank chamber 6*a* increases due to the descending movement of the piston 15, the one-way valve 61 opens and, as a result, the above-mentioned oil mist ascends inside the oil feed pipe 60 together with the blowby gas generated in the crank chamber 6*a* and is supplied to the valve operation chamber 21, so lubricating the camshaft 26, the cam followers 24 and 25, etc.

When the oil mist and the blowby gas inside the valve operation chamber 21 enter the gas-liquid separation passage 68 inside the rotating camshaft 26, gas and liquid are separated by centrifugation inside the passage 68, the liquefied oil is returned to the valve operation chamber 21 via the transverse hole 68*a* of the gas-liquid separation passage 68, but the blowby gas is taken into the engine E via the breather chamber 69, the breather pipe 70 and the air cleaner 4, in that order, during the intake stroke of the engine E.

Since the valve operation chamber 21 is communicated with the inside of the air cleaner 4 as aforementioned via the gas-liquid separation passage 68, the breather chamber 69 and the breather pipe 70, the pressure within the valve operation chamber 21 is maintained at or slightly below atmospheric pressure.

On the other hand, the pressure of the crank chamber 6*a* is negative on average since the positive pressure component alone of the pressure pulsations is discharged through the one-way valve 61. The negative pressure is transmitted to the oil tank 40 via the through hole 55 and further to the suction chamber 74 via the oil return pipe 78. The pressure in the suction chamber 74 is therefore lower than that in the valve operation chamber 21, and the pressure in the oil tank 40 is lower than that in the suction chamber 74. As a result, the pressure is transferred from the valve operation chamber 21 to the suction chamber 74 via the suction pipes 75 and 76 and the orifices 73, 73 . . . and further to the oil tank 40 via the oil return pipe 78, and accompanying this transfer the oil mist inside the valve operation chamber 21 and the liquefied oil retained in the valve operation chamber 21 are drawn up into the suction chamber 74 through the suction pipes 75 and 76 and the orifices 73, 73 . . . and returned to the oil tank 40 through the oil return pipe 78.

As mentioned above, since the four orifices 73, 73 . . . are provided at four points of the bottom wall of the suction chamber 74 and the orifices 73 and 73 are provided in the long and short suction pipes 74 and 75 projecting into the valve operation chamber 21 from the central part of the bottom wall with a space between the long and short suction pipes 74 and 75 in the directions perpendicular to the axis of the camshaft 26, one of the six orifices 73, 73 . . . is immersed in the oil stored in the valve operation chamber 21 regardless of the operational position of the engine E such as an upright state (A), a leftward tilted state (B), a rightward tilted state (C), a leftward laid state (D), a rightward laid state (E) and an upside down state (F) as shown in FIG. 10 and the oil can be drawn up into the suction chamber 74.

Since the oil mist so generated in the oil tank 40 is thus supplied to the crank chamber 6*a* and the valve operation chamber 21 of the OHC type four-cycle engine E utilising the pressure pulsations of the crank chamber 6*a* and the function of the one-way valve 61 and is returned to the oil tank 40, the inside of the engine E can be lubricated reliably by the oil mist regardless of the operational position of the engine E; moreover a special oil pump for circulating the oil mist is unnecessary and the structure can thus be simplified.

Not only the oil tank 40 which is made of a synthetic resin but also the oil feed pipe 60 providing communication between the crank chamber 6*a* and the valve operation chamber 21 and the oil return pipe 78 providing communication between the suction chamber 74 and the oil tank 40 are placed outside the engine main body 1, there is no obstruction in making the engine main body 1 thinner and more compact, and this can thus contribute greatly to a reduction in the weight of the engine E. In particular, since the externally placed oil feed pipe 60 and oil return pipe 78 are less influenced by heat from the engine main body 1, overheating of the lubricating oil O can be prevented. Furthermore, the integral formation of the oil feed pipe 60, the oil return pipe 78 and the belt cover 36 can contribute to a reduction in the number of parts and an enhancement in the assembly performance.

Figure 11:
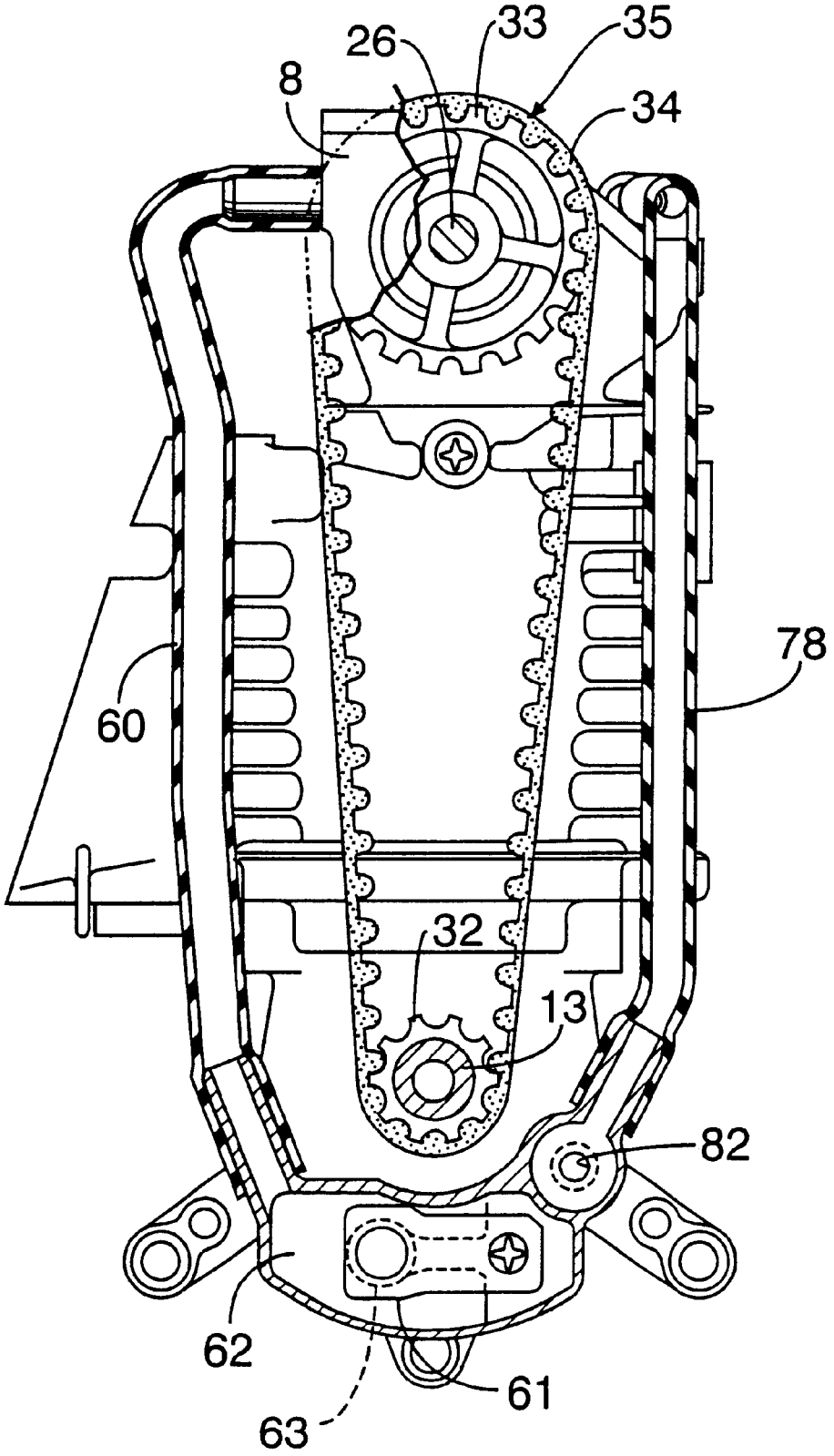
FIG. 11 is a cross-sectional view corresponding to FIG. 7, showing a modified embodiment of the oil feed pipe and oil return pipe.

FIG. 11 shows a modified embodiment of the oil feed pipe 60 and the oil return pipe 78, and in this case the oil feed pipe 60 and the oil return pipe 78 are formed from a tube which is made of a flexible material such as rubber and which is separated from the belt cover 36. Since the other components are the same as those in the above-mentioned embodiment, the corresponding parts in the drawing are denoted by the same reference numerals and their explanation is omitted.

In accordance with the modified embodiment, the oil feed pipe 60 and the oil return pipe 78 can be freely fitted to connection points, wherever the points are located, by appropriately flexing the pipes 60 and 78, and the degrees of freedom of the layout can be increased.

The present invention is not limited to the above-mentioned embodiments and can be modified in a variety of ways without departing from the spirit and scope of the invention. For example, a rotary valve in association with the crankshaft 13 and operating so as to unblock the oil feed pipe 60 when the piston 15 descends, and to block the oil feed pipe 60 when the piston 15 ascends can be provided instead of the one-way valve 61.

What is claimed is:

1. A handheld type four-cycle engine including:

an engine main body, the engine main body including a crankcase having a crank chamber, a cylinder block having a cylinder bore and a cylinder head having an intake port and an exhaust port;

a crankshaft supported in the crankcase and housed inside the crank chamber;

a piston fitted inside the cylinder bore and connected to the crankshaft;

an intake valve and an exhaust valve for opening and closing the intake port and exhaust port, the intake valve and the exhaust valve being mounted in the cylinder head;

a valve operation mechanism operable in association with the rotation of the crankshaft via a dry system timing transmission so as to open and close the intake valve and the exhaust valve; and a power output mechanism provided on one end of the crankshaft projecting out of the engine main body, wherein the engine further includes a lubrication system which has:

an oil tank placed outside the main engine body and storing lubricating oil;

a through hole providing communication between the oil tank and the crank chamber;

an oil feed pipe placed outside the engine main body and providing communication between the crank chamber and a valve operation chamber, the valve operation chamber being formed in the cylinder head so as to house the valve operation mechanism;

an oil return pipe also placed outside the engine main body and providing communication between the valve operation chamber and the oil tank; and transfer means for transferring the oil inside the oil tank to the oil feed pipe via the crank chamber, wherein the valve operation mechanism includes a camshaft supported in a rotatable manner in the cylinder head so as to open and close the intake valve and the exhaust valve, said dry system timing transmission placed outside the engine main body and operatively connecting the crankshaft to the camshaft, oil mist generation means for generating an oil mist from the stored oil is provided inside the oil tank, and the transfer means for transferring the oil mist generated inside the oil tank to the oil feed pipe includes valve means for introducing the positive pressure component of pressure pulsations of the crank chamber to the oil feed pipe, wherein a belt cover made of a synthetic resin is placed between the engine main body and the timing transmission, the belt cover being fixed to the engine main body, and wherein the oil feed pipe is formed integrally with the belt cover, and a valve chamber is integrally formed with the belt cover at a lower end of the oil feed pipe, said valve means being disposed in said valve chamber.

2. A handheld type four-cycle engine including an engine main body, the engine main body including a crankcase having a crank chamber, a cylinder block having a cylinder bore and a cylinder head having an intake port and an exhaust port;

a crankshaft supported in the crankcase and housed inside the crank chamber;

a piston fitted inside the cylinder bore and connected to the crankshaft;

an intake valve and an exhaust valve for opening and closing the intake port and exhaust port, the intake valve and the exhaust valve being mounted in the cylinder head;

a valve operation mechanism operable in association with the rotation of the crankshaft so as to open and close the intake valve and the exhaust valve; and a power output mechanism provided on one end of the crankshaft projecting out of the engine main body, wherein the engine further includes a lubrication system which has:

an oil tank placed outside the engine main body and storing lubricating oil;

a through hole providing communication between the oil tank and the crank chamber;

an oil feed pipe placed outside the engine main body and providing communication between the crank chamber and a valve operation chamber, the valve operation chamber being formed in the cylinder head so as to house the valve operation mechanism;

an oil return pipe also placed outside the engine main body and providing communication between the valve operation chamber and the oil tank; and transfer means for transferring the oil inside the oil tank to the oil feed pipe via the crank chamber, wherein the oil feed pipe and the oil return pipe are formed integrally with a belt cover provided between the outside face of the engine main body and a timing transmission of the valve operation mechanism.

3. A handheld type four-cycle engine according to claim 1, wherein the oil feed pipe and the oil return pipe include flexible tubes.

4. A handheld type four-cycle engine according to claim 1, wherein a suction chamber adjoining the upper part of the valve operation chamber is provided in the cylinder head, the oil return pipe being connected to the suction chamber, and the suction chamber is communicated with the valve operation chamber via a plurality of orifices at different height levels.

5. A handheld type four-cycle engine according to claim 2, wherein oil mist generation means for generating an oil mist from the stored oil is provided inside the oil tank, and the transfer means for transferring the oil mist generated inside the oil tank to the oil feed pipe has valve means for introducing the positive pressure components of pressure pulsations of the crank chamber to the oil feed pipe.

* * * * *